US008336161B1

(12) United States Patent
Bettencourt

(10) Patent No.: US 8,336,161 B1
(45) Date of Patent: Dec. 25, 2012

(54) AIR WIPING DEVICE

(75) Inventor: Stephen Bettencourt, Warren, RI (US)

(73) Assignee: Huestis Machine Corporation, Bristol, RI (US)

( * ) Notice: Subject to any disclaimer, the term of this patent is extended or adjusted under 35 U.S.C. 154(b) by 443 days.

(21) Appl. No.: 12/689,466

(22) Filed: Jan. 19, 2010

(51) Int. Cl.
*B08B 5/00* (2006.01)

(52) U.S. Cl. ..... 15/309.1; 15/504

(58) Field of Classification Search ..... 134/64 R, 134/198, 95.2; 15/309.1, 405
See application file for complete search history.

(56) References Cited

U.S. PATENT DOCUMENTS

| | | | | |
|---|---|---|---|---|
| 3,044,098 | A * | 7/1962 | Stalson | 15/302 |
| 3,270,364 | A * | 9/1966 | Steele | 15/309.1 |
| 3,496,086 | A * | 2/1970 | Stalson et al. | 204/208 |
| 4,033,785 | A * | 7/1977 | Gibbs | 134/15 |
| 4,296,556 | A * | 10/1981 | Bray | 34/107 |
| 4,439,991 | A * | 4/1984 | Muzak | 62/63 |
| 4,461,654 | A * | 7/1984 | Stalson et al. | 134/10 |
| 4,811,748 | A * | 3/1989 | Murao et al. | 134/122 R |
| 5,551,226 | A | 9/1996 | Keir et al. | |
| 5,558,113 | A * | 9/1996 | Casteel et al. | 134/122 R |
| 5,634,236 | A | 6/1997 | Darsey | |
| 5,671,878 | A * | 9/1997 | Kawasaki | 226/196.1 |
| 5,758,530 | A * | 6/1998 | Yoshikawa et al. | 72/40 |
| 5,943,729 | A | 8/1999 | Watkins | |
| 6,003,194 | A * | 12/1999 | Eckroth | 15/302 |
| 6,267,822 | B1 | 7/2001 | Watkins | |
| 6,612,913 | B2 * | 9/2003 | Bailey et al. | 451/59 |
| 6,865,875 | B2 | 3/2005 | Watkins | |
| 2004/0172932 | A1 | 9/2004 | Watkins | |
| 2009/0131852 | A1 | 5/2009 | Hooi | |

FOREIGN PATENT DOCUMENTS

| | | |
|---|---|---|
| JP | 05-5238543 | * 9/1993 |
| JP | 07-033235 | * 2/1995 |
| JP | 07-300687 | * 11/1995 |

* cited by examiner

*Primary Examiner* — Frankie L Stinson
(74) *Attorney, Agent, or Firm* — Team Best Legal Dept.; Oneal R Mistro

(57) ABSTRACT

The air wiping device includes a housing having an internal elongated tubular passage through which the elongated product extends and including opposite one and other ends with the housing tubular passage having an inlet end and an outlet end for respectively receiving and passing the elongated product; a first set of nozzles mounted at the one end of the housing for communicating a compressed gas stream to the internal elongated tubular passage and second set of nozzles mounted at the other end of the housing for communicating a compressed gas to the internal elongated tubular passage. A ceramic insert is disposed in the internal tubular passage of the housing and through which the elongated product passes. The ceramic insert includes a tapered input through which the elongated product is received and an output through which the elongated product passes from the housing. The first and second sets of nozzles are mounted for directing the respective gas streams in a direction having a compressed gas stream component toward each other for discharge transversely from the housing.

19 Claims, 9 Drawing Sheets

AIR WIPING DEVICE

RELATED APPLICATIONS

This application relates to co-pending applications filed of even date herewith and presently identified patent application Ser. No. 12/689,384 and patent application Ser. No. 12/689,242. These related applications are now hereby incorporated by reference herein in their entirety.

TECHNICAL FIELD

The present invention relates in general to an air wiping device. More particularly the present invention relates to a cleaning device for a variety of different types of products, particularly elongated members such as fiber, wiring or cabling. Even more particularly the present invention relates an air wiping device that is characterized by an improvement to the drying process.

BACKGROUND OF THE INVENTION

In the manufacturing of wire, or other similar elongated products, there is a need to remove liquids and contaminants from the surface of the product. For example, in the production of wire, it is necessary that cooling fluids or cleansing acids be removed from the wire prior to spooling, storage, or subsequent processing. It is known in this art to use compressed air to remove liquid or contaminants from wire, or the like, as it passes through a tube. By way of example refer to U.S. Pat. Nos. 5,634,236 and 6,267,822, as well as an air wipe product sold by Huestis Machine Corporation of Bristol Rhode Island, and the assignee of the present invention, all of which are hereby incorporated by reference herein in their entirety. These known air wiping devices use compressed air that is vented into the tube through radially or tangentially directed holes and the liquid is removed by the force of the pressurized air traveling in the opposite direction of the moving wire. There have been numerous problems associated with past attempts to remove liquid from moving elongated members using such prior art methods.

One problem associated with known air wiping devices is that when one desires to change the cable size being processed, the entire air wipe product has to be substituted. Another problem with known air wiping devices is that in order to provide a hard surface in the inner tube of the air wiping device the entire device is usually constructed of a ceramic material as mentioned in U.S. Pat. No. 6,267,822. This makes the device expensive to manufacture. Also other devices that are used are constructed of materials that do not withstand the wear caused by the passing cable (at high speed), and thus damage to the device is common, particularly where initial misalignment occurs.

Another problem with existing devices is that when they are ganged in series there can be interference from one device to the next adjacent device. This occurs because the exhausted liquid tends to pass in a direction opposite to the direction of conveyance of the elongated member. Thus, there is a tendency for liquid, from a downstream device, to undesirably impact on the upstream device. In many facilities where air wiping devices are used there is a severe space constraint and thus these air wiping devices have to be mounted quite close to each other. The end result is that the ganging of these devices does not attain the desired result, namely of properly drying the elongated member.

Accordingly, it is an object of the present invention to provide an improved air wiping device in which the discharge from the device is directed so as to not interfere with any adjacently disposed devices.

Another object of the present invention is to provide an improved air wiping device that is characterized by using two sets of nozzles that direct the output flow from the device in a direction that is substantially orthogonal to the direction of movement of the elongated member being dried.

It is a further object of the present invention to provide an improved air wiping device in which the entire air wiping device does not have to be substituted when one wants to change cable or wire size. Instead, in accordance with the present invention a separable insert is used that enables the substitution of tubing size to accommodate different size cabling or wiring. This insert substitution enables the construction of an overall less expensive device.

Still another object of the present invention is to provide an improved air wiping device that is characterized by improved wear resistance. Normally the conventional air wiping device is installed in a production line and it is meant to be perfectly aligned on the central axis of the processed material. It is typical that operators may be too rushed or lazy to perform a proper alignment and thus the body wears out quickly. This usually results in the destruction of the device requiring a complete replacement of the device. However, in accordance with the improved air wiping device of the present invention the ceramic insert bore provides excellent wear resistance and compensates for misalignments. Moreover, the replaceable ceramic insert alone is less costly than the cost of a complete air wiping device.

SUMMARY OF THE INVENTION

In accordance with the present invention there is provided an air wiping device for drying an elongated product that passes through the air wiping device. The air wiping device comprises a housing having an internal elongated tubular passage through which the elongated product extends and including opposite one and other ends; the housing tubular passage having an inlet end and an outlet end for respectively receiving and passing the elongated product; a first set of nozzles mounted at the one end of the housing for communicating a compressed gas stream to the internal elongated tubular passage; and a second set of nozzles mounted at the other end of the housing for communicating a compressed gas to the internal elongated tubular passage. The first and second sets of nozzles are mounted for directing the respective gas streams obliquely to the internal elongated tubular passage. Moreover, the first and second sets of nozzles are mounted for directing the respective gas streams in a direction having a compressed gas stream component toward each other for discharge transversely from the housing.

In accordance with the present invention a ceramic insert is disposed in the internal tubular passage of the housing and through which the elongated product passes. The ceramic insert includes a tapered input through which the elongated product is received and an output through which the elongated product passes from the housing. The ceramic insert provides an extremely durable work surface for the elongated product. The ceramic insert is comprised of a pair of insert sections. The housing section includes a first housing section and a second housing section, the pair of insert sections including a first insert section and a second insert section, the first insert section mounted in the first housing section and the second insert section mounted in the second housing sections; including separate fastener means for removably attaching the respective insert sections to the housing sections; each of the insert sections and housing sections are substantially semi-circular in shape; and the fasteners retain the insert sections in place in the elongated tubular passage and together define an inner passage through which the elongated product passes.

In accordance with other aspects of the present invention the housing is separated into two housing sections; the housing sections are connected by a hinge that biases the housing sections to a closed position; each of the sets of nozzles are disposed about a 360 degree locus; each of the housing sections is substantially semi-circular in shape; the input end of the housing tubular passage includes a tapered input through which the elongated product is received and an output through which the elongated product passes from the housing; including a mounting bracket for the housing that mounts the housing in a manner by which the housing may still move toward an open position should an object associated with the elongated product engage the tapered input so as to avoid damage to the device; the housing sections include a slot that is used for the support of the housing from the bracket; the first and second sets of nozzles extend at substantially the same angle to the longitudinal axis of the housing; the elongated tubular passage is defined with a tapered input through which the elongated product is received and an output through which the elongated product passes from the housing; the housing includes a transverse port that extends substantially orthogonal to the elongated tubular passage in the housing and for receiving the discharge from the housing; and the housing includes a pair of separable housing sections and a transverse port that extends between the housing sections substantially orthogonal to the elongated tubular passage in the housing and for receiving the discharge from the housing.

In accordance with other versions of the present invention there is provided an air wiping device for drying an elongated product that passes through the air wiping device. The air wiping device comprises a housing having an internal elongated tubular passage through which the elongated product extends and including opposite one and other ends; the housing tubular passage having an inlet end and an outlet end for respectively receiving and passing the elongated product; a first set of air outlets mounted at the one end of the housing for communicating a compressed gas stream to the internal elongated tubular passage; and a second set of air outlets mounted at the other end of the housing for communicating a compressed gas to the internal elongated tubular passage. The first and second sets of air outlets are mounted for directing the respective gas streams obliquely to the internal elongated tubular passage while the first and second sets of air outlets are mounted for directing the respective gas streams in a direction having a compressed gas stream component toward each other for discharge transversely from the housing. Each set of air outlets directs an air stream at substantially the same angle to the elongated member axis, and each at an angle less than 90 degrees.

In accordance with still other aspects of the present invention the housing is separated into two housing section, the housing sections are connected by a hinge that biases the housing sections to a closed position and each of the sets are disposed about a 360 degree locus; each of the housing sections is substantially semi-circular in shape; the input end of the housing tubular passage includes a tapered input through which the elongated product is received and an output through which the elongated product passes from the housing; including a mounting bracket for the housing that mounts the housing in a manner by which the housing may still move toward an open position should an object associated with the elongated product engage the tapered input so as to avoid damage to the device; the housing sections include a slot that is used for the support of the housing from the bracket; the housing includes a transverse port that extends substantially orthogonal to the elongated tubular passage in the housing and for receiving the discharge from the housing; and the housing includes a pair of separable housing sections and a transverse port that extends between the housing sections substantially orthogonal to the elongated tubular passage in the housing and for receiving the discharge from the housing.

DESCRIPTION OF THE DRAWINGS

Numerous other objects, features and advantages can be realized in accordance with the present invention by referring to the accompanying drawings, in which.

and

Figure 10:
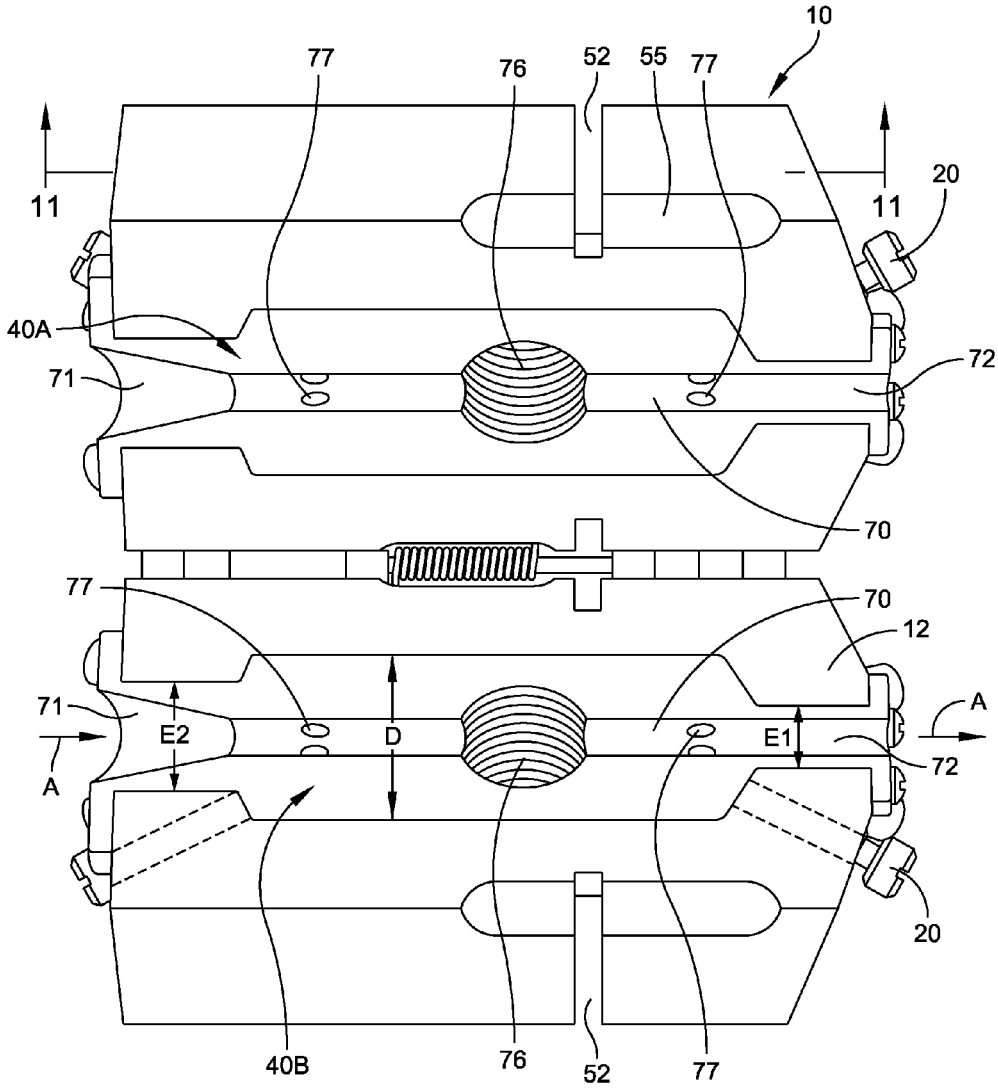

FIG. 10 is a front view with the housing open.

DETAILED DESCRIPTION

Reference is now made to the present preferred embodiment of the present invention which is illustrated in the accompanying drawings. The device of the present invention removes particulate matter or other adherent material from an elongated member such as wiring or cabling. The device will effectively remove any material loosely adhered to the elongated member such as liquids, particulate solids, contaminants or combinations thereof. Although it shows particular utility in removing liquids or other materials from elongated solids such as wires or cables, the principles of the present invention may also apply to cleaning any number of other elongated substances.

In accordance with the present invention, the device generally includes a housing having a chamber with a plurality of air inlets for receiving compressed air into the chamber, a central tube for receiving an elongated member as it is traveling into the chamber, and an exit for allowing the elongated member to leave the chamber. Furthermore, the compressed air is generally expelled (with removed material) through the central tube.

Figure 8:
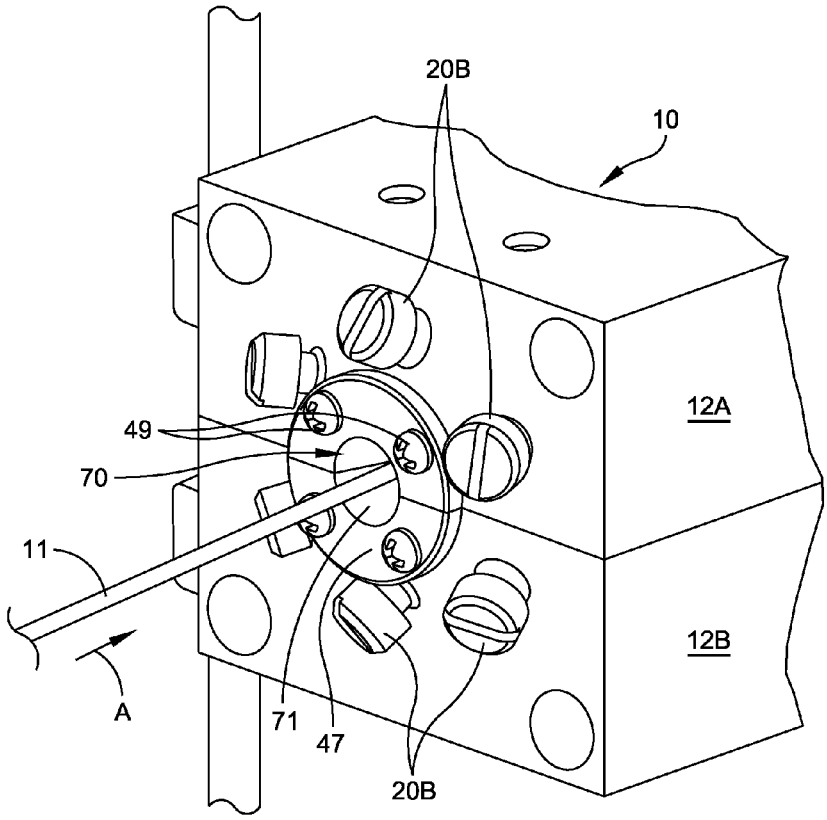
FIG. 8 is a fragmentary perspective view at the left side of the device.
Figure 9:
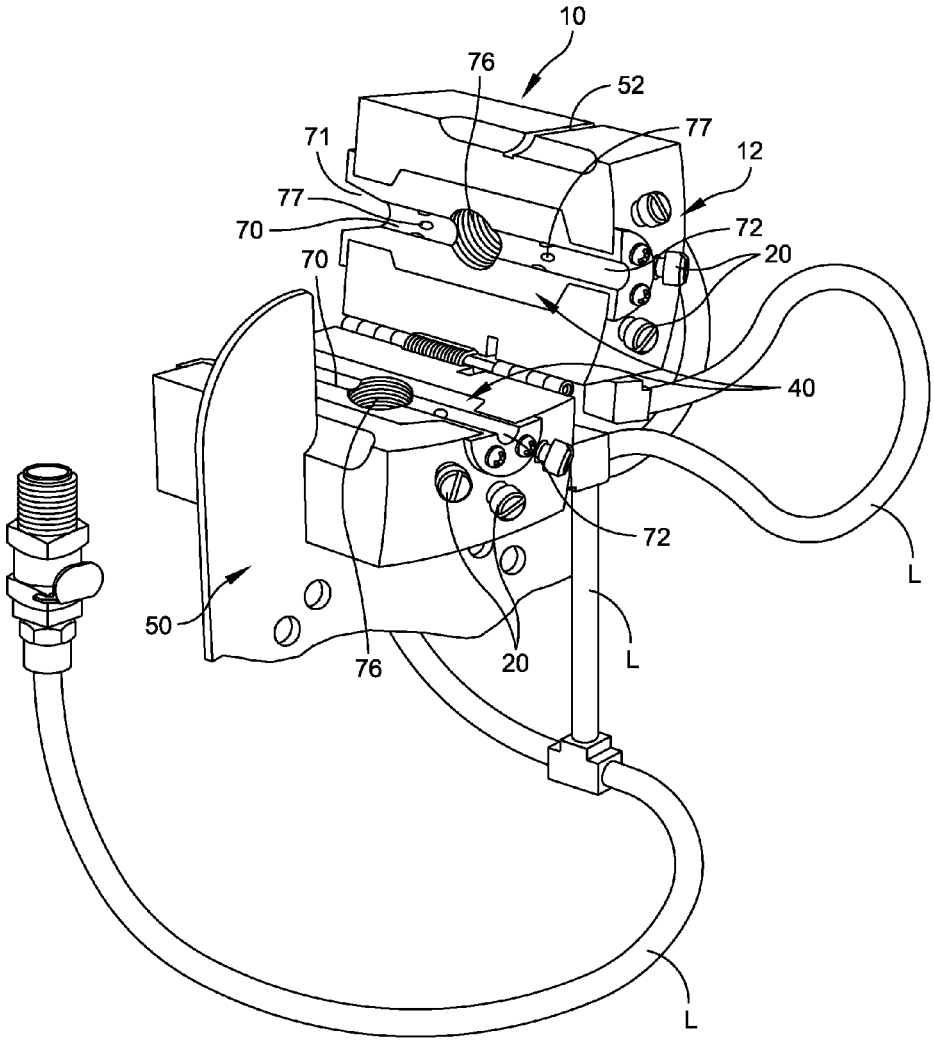
FIG. 9 is a perspective view of the device of FIG. 1 with the housing in an open position.

As here embodied and depicted in the drawings, there is shown an air wiping device designated by the numeral 10. The device 10 is used to remove liquid and/or other materials from an elongated member 11 having a generally circular cross-sectional area and moving in the direction of the arrows A illustrated in FIGS. 3, 6 and 8. Additionally, air wiping device 10 is depicted as being used in conjunction with a compressed air delivering system (not shown). Part of the delivery system is shown in FIGS. 1 and 9 by the air lines L.

Device 10 includes housing 12 having an internal plenum chamber 14 into which the compressed air is coupled from the lines L. The chamber 14 couples the compressed air to the plurality of nozzles 20. The nozzles 20 are each meant to provide a jet stream of air or any other gas directed to the elongated product as the elongated product or member is conveyed through the air wiping device.

Figure 1:
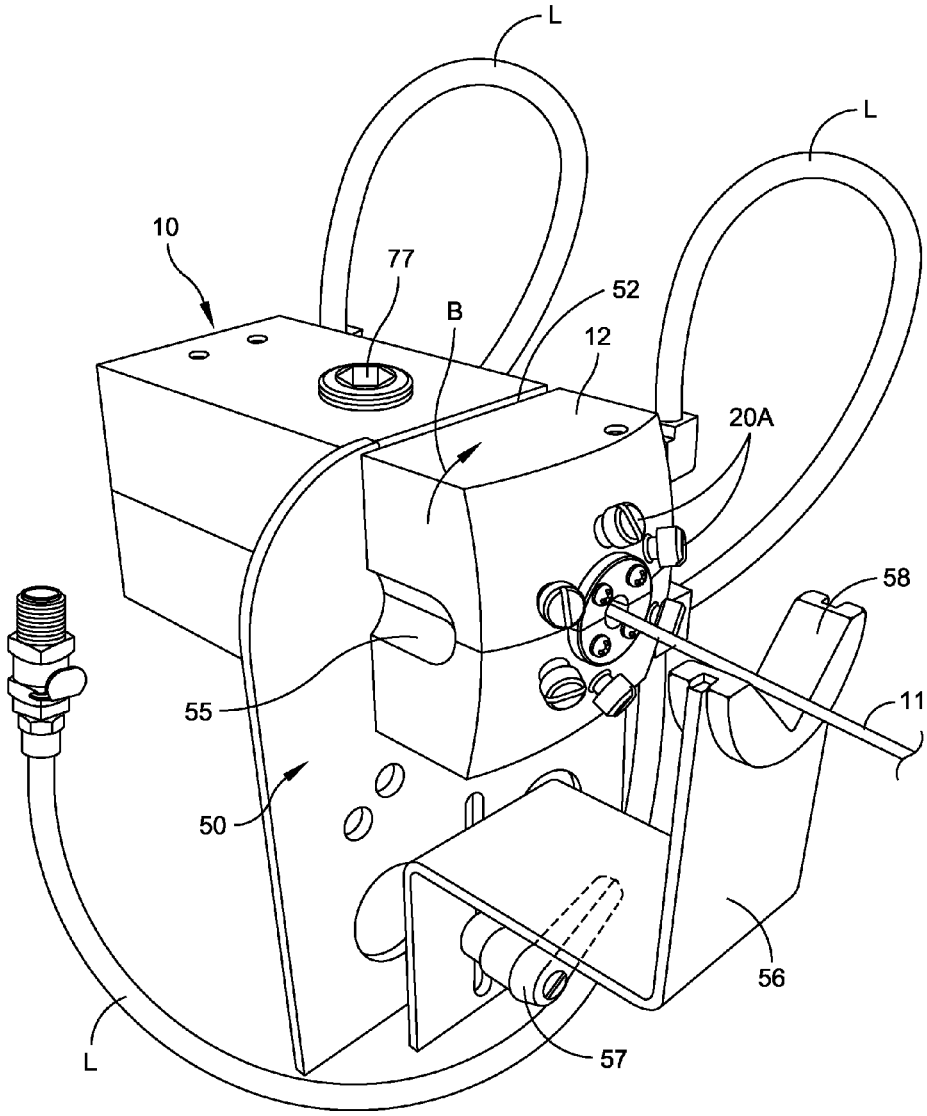
FIG. 1 is a perspective view of one embodiment of the air wiping device constructed in accordance with the principles of the present invention and illustrated as supported from a mounting bracket.

Reference is now made to the perspective view of FIG. 1 that illustrates the air wiping device 10 of the present invention as supported by the bracket 50. Refer also to the partial perspective view of FIG. 9 which shows a portion of the bracket 50. The bracket supports the device 10 primarily by means of an engagement of the planar-shaped bracket 50 with the slot 52. From FIG. 9 it is noted that the bracket 50 is open at its top end so that the housing 12 can move from a closed position as illustrated in FIG. 1 to an open position as illustrated in FIG. 9. A pair of spring loaded ball plungers engage matings holes in the bracket providing tooless unit removal from the bracket or securing screws may be used for securing the housing to the bracket.

Figure 4:
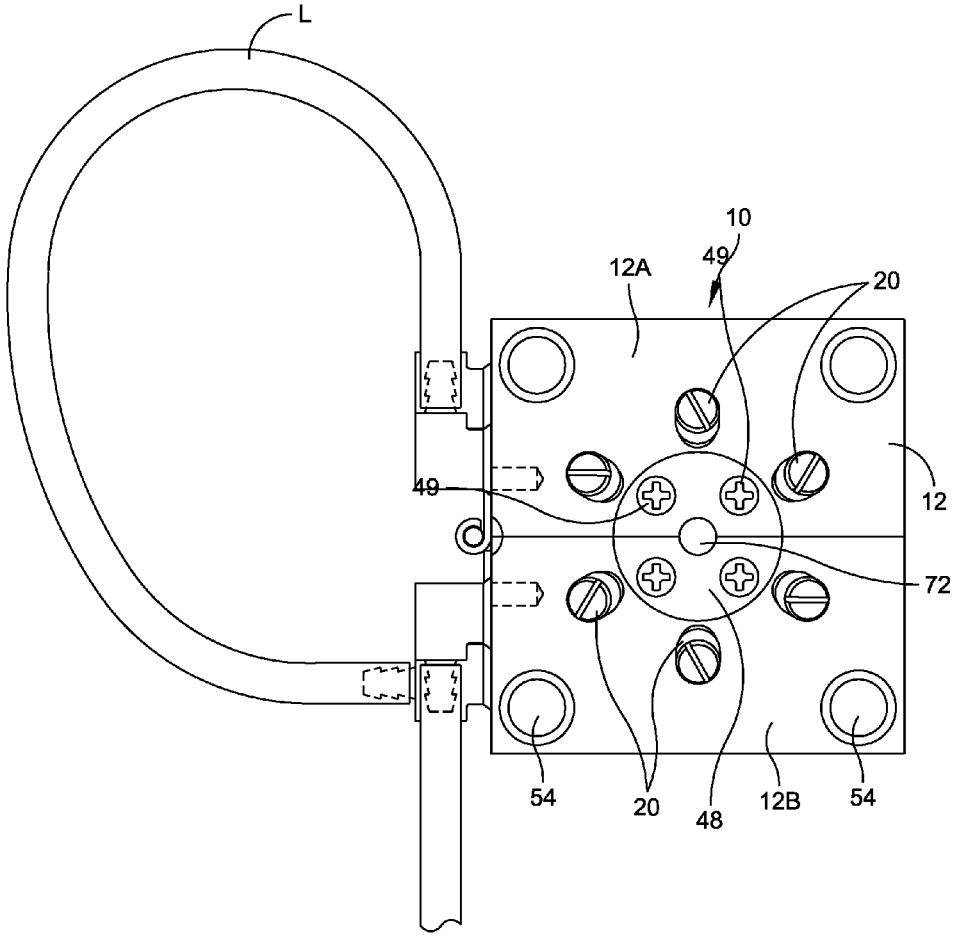
FIG. 4 is a left side view of the air wiping device of FIG. 1.

This is illustrated in FIG. 4 wherein passages 54 may accommodate securing screws that may be spring loaded and have ends that are urged against the planar surface of the bracket 50.

The bracket 50 may also support a further bracket 56 whose position relative to the bracket 50 is adjustable by means of a knob 57. A top end of the bracket 56 supports a guide piece 58 through which the elongated member may be supported and extend. The guide piece 58 is preferably constructed of a hard material such as a ceramic material.

The housing 12 is illustrated as being formed in two sections with a common depression 55 that provides a gripping surface for opening the two sections of the housing against the bias of a supporting spring. FIG. 1 also illustrates by arrow B the direction of opening of a top housing section relative to a bottom housing section.

Figure 3:
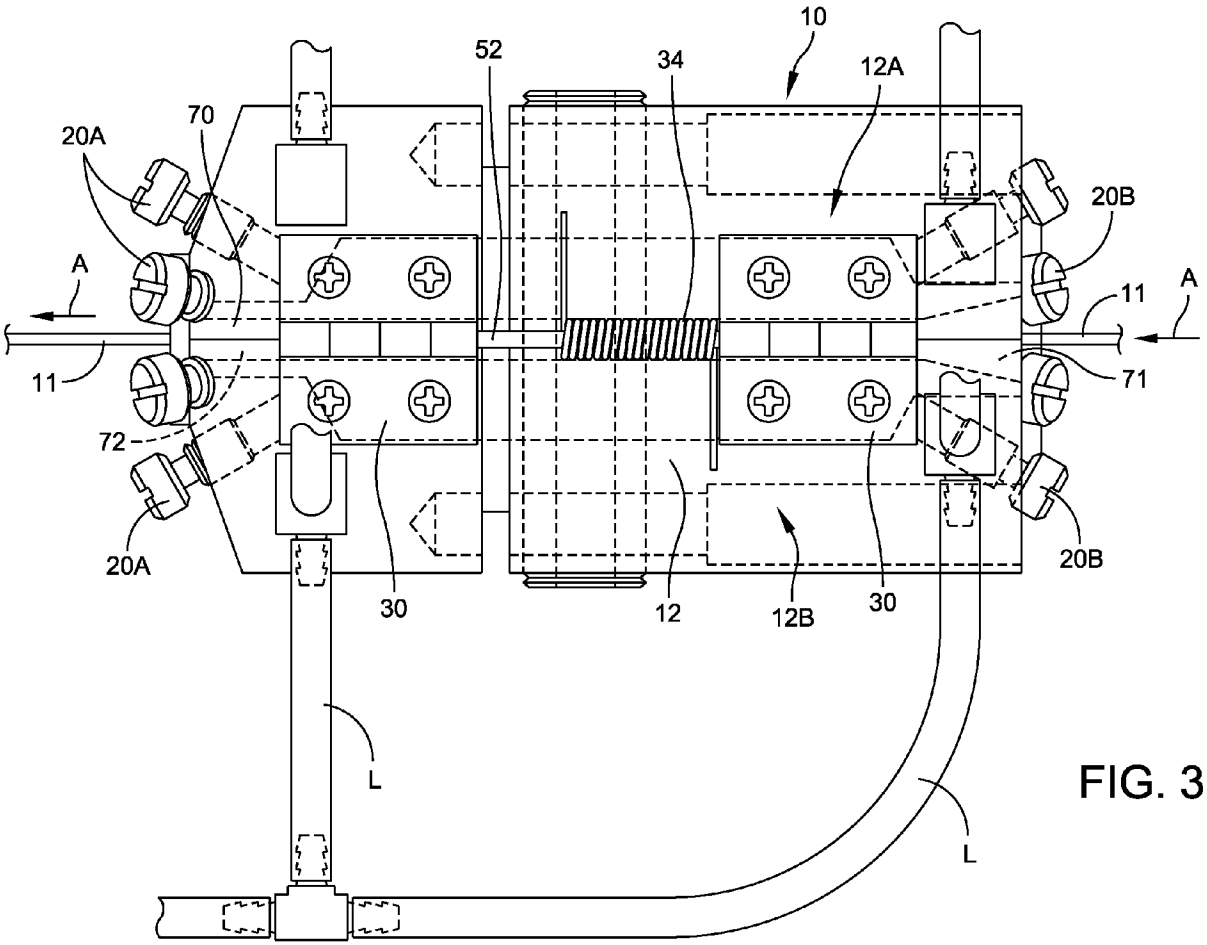
FIG. 3 is a rear view of the air wiping device of FIG. 1.

The housing 12 is considered as separated into two like housing sections identified as sections 12A and 12B in the drawings. These two sections are interconnected by means of a hinge arrangement that is best illustrated in FIG. 3. This includes hinge plates 30, hinge pin 32 and biasing spring 34. The hinge pin 32 extends between the hinge plates 30 and the biasing spring 34 is wound about the hinge pin 32. This arrangement biases the two housing sections to a closed position such as the one illustrated in FIG. 1.

Figure 2:
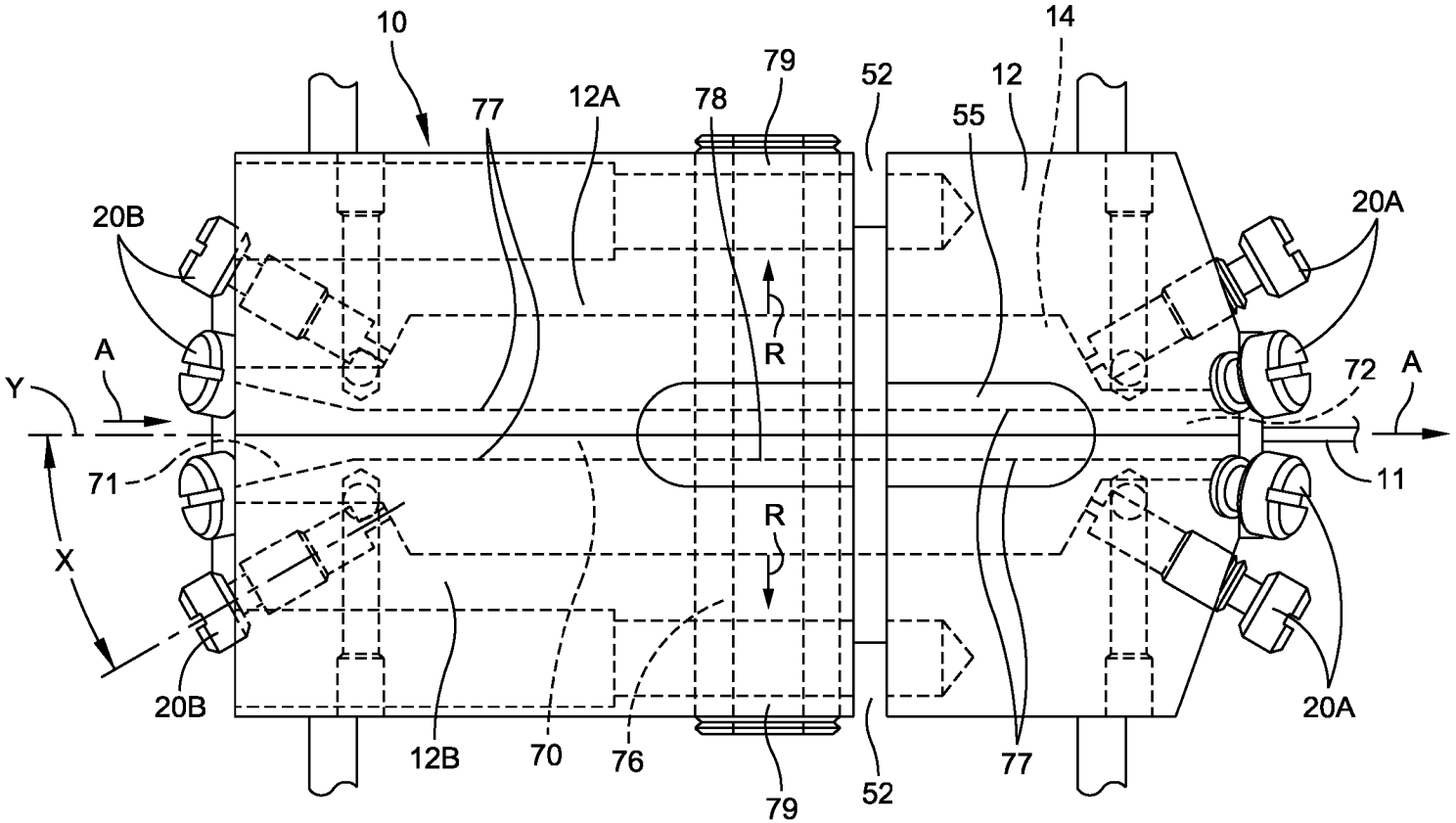
FIG. 2 is a front view of the air wiping device of FIG. 1.
Figure 6:
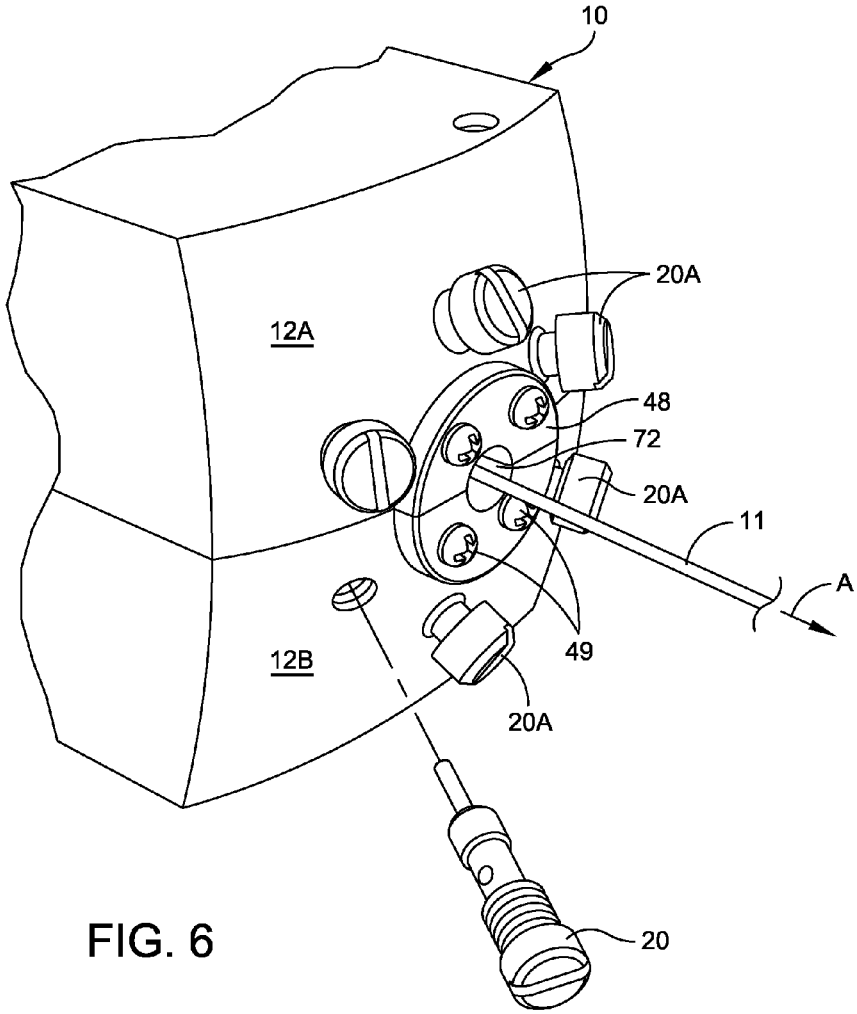
FIG. 6 is a fragmentary perspective view at the right side of the device and showing the nozzle exploded from the housing.
Figure 7:
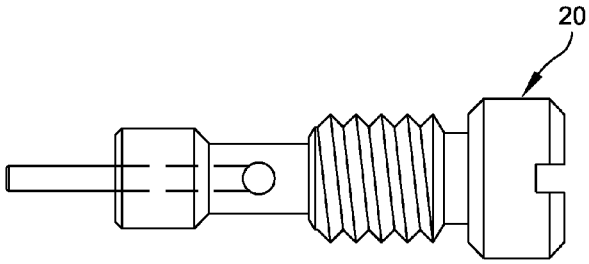
FIG. 7 is an illustration of the nozzle.

FIG. 2 illustrates the position of the nozzles 20. These nozzles are adapted to be screwed into the respective housing sections with their being provided in the disclosed embodiment three nozzles for each of the housing sections. In this regard refer to FIG. 5 that shows the three separate nozzles associated with respective housing sections 12A and 12B. Refer also to FIG. 2 which shows the nozzles 20 coupling to the plenum chamber 14. Refer also to FIGS. 6 and 7. FIG. 7 in particular illustrates the construction of the nozzle 20 which includes a head, a threaded section and a port through which the compressed air passes. The nozzles are disposed so as to direct compressed air from an input plenum to an elongated internal tubular passage. FIG. 10 illustrates the general shape of this internal passage. The nozzles 20 may be of conventional design.

As indicated previously in accordance with the present invention, there is provided an air wiping device for drying an elongated member or product that passes through the air wiping device. The device basically includes a housing 12 in separate housing sections 12A and 12B that together define an internal elongated tubular passage 70 through which the elongated product extends. The elongated tubular passage 70 has an inlet end 71 that is tapered as illustrated in FIGS. 3, 9 and 10. Refer also to FIG. 2. The passage 70 also includes an outlet end 72. The passage 70 may be of the same diameter along almost its complete length with the exception of the input taper at 71.

In the embodiment that is described herein, at each end of the device there is a set of nozzles for communicating a compressed gas stream to the internal elongated tubular passage 70. These are provided in two separate sets of nozzles each comprising six nozzles. However, different numbers of nozzles may be used in each set. Preferably each set of nozzles extends about a substantially 360 degree circular locus. The first and second sets of nozzles are mounted for directing their respective gas streams obliquely to the internal elongated tubular passage. In this regard, reference may be made to FIGS. 2 and 3 and in particular to FIG. 2 which shows a first set of nozzles 20A at the right in FIG. 2 and a second set of nozzles 20B to the left in FIG. 2. It is noted that each of these sets of nozzles directs a stream at an angle X that is oblique to the center axis Y of the elongated tubular passage 70. The angle X is less than 90 degrees and is preferably in a range of 15-60 degrees. Both angles are preferably the same.

The first and second sets of nozzles are mounted for directing the respective gas streams in a direction having a compressed gas stream component toward each other for discharge transversely from the housing through the transverse port 76. As illustrated in FIG. 2, the port 76 actually passes through each of the respective housing sections 12A and 12B. Refer also to FIGS. 9 and 10 for an illustration of the transverse port 76 which is illustrated as being threaded so as to receive a fitting 77 that is illustrated in FIG. 1. This transverse porting enables the discharged product from being forced in either direction away from the device and in a direction orthogonal to the direction of travel of the wiring or cabling. In accordance with the present invention this discharge may occur through both ports or through selectively either one of the ports 76. The port 76 passes through, not only the respective housing sections, but also through a portion of each of the inserts as depicted in FIG. 10.

FIG. 2 illustrates the first and second sets of nozzles, namely nozzles 20A and 20B. FIG. 2 also illustrates the manner in which the nozzles are disposed. Each of the nozzles has an outlet port at 77. Refer also to FIGS. 9 and 10 that show the ports 77. With three nozzles on either side in each of the housing sections, there will thus be a corresponding number of three ports.

FIG. 2 also shows the direction of travel of the elongated cabling or wiring along the axis Y. The nozzle set 20A thus is directed in a direction having a component opposite to the direction of travel of the wire or cabling as indicated by the arrow A. This means that there would be a tendency, if only nozzles 20A were used, for a discharge to occur in a direction opposite to the direction of movement of the elongated member. However, in accordance with the present invention, there is also provided a second set of nozzles identified in, for example, FIG. 2 as nozzles 20B which direct the compressed air stream having a component in an opposite direction to that of the nozzle set 20A. This creates a relatively high pressure area at 78 causing a discharge from the housing along the direction of arrows R. In this regard a vacuum occurs at 79 near the exit of the housing. This arrangement provides for a discharge of the liquid or fluid in a direction substantially transverse and preferably orthogonal to the axis Y. This is particularly important in connection with an arrangement in which air wiping devices may be ganged from one to the next in a relatively small area.

Now, in accordance with the present invention, there is provided a ceramic insert which is probably best illustrated in FIGS. 9 and 10. This insert is generally referred to by the reference number 40 and in, for example, FIGS. 9 and 10, the insert is shown as separated into two insert sections 40A and 40B. Each of the insert sections is substantially identical in shape and contour in the embodiment disclosed herein. The outer surface of each of the inserts is configured to match the tubular passage within the associated housing section. With reference to, for example, FIG. 10 and the ceramic insert section 40B, as with the other insert section, there is included a tapered input 71 and an output at 72, a constant diameter center passage 70 extends between the tapered input 71 and the output 72. The elongated member being processed passes at a particular speed through the center passage 70. The ceramic insert also has a larger diameter shown at D and opposed smaller respective end diameters at E1 and E2. There is also a transition between the larger diameter section D and each of the smaller diameter sections E1, E2. The reduced diameter portions are important in minimizing the amount of ceramic material adjacent to the output end so that the nozzles 20*a*, 20B located at that area can more directly couple compressed air into the center passage 70. For this purpose, as noted in FIG. 10, there are a series of ports 77, one associated with each of the nozzles 20. In the present embodiment wherein there are three nozzles in each of the housing sections, then there would be three corresponding ports 77. It is noted that the ceramic insert section 40A is also provided with similar ports, illustrated at 77. FIG. 10 also illustrates by arrow A the direction of passing of the elongated member. It is noted that the ports 77 are directed at an angle having a component that is respectively opposite to and in line with the direction of travel of the elongated member. Each of the ports 77 actually extend, not only through each ceramic insert, but also through the housing body so that there is complete fluid communication from each nozzle to the central passage.

Each of the ceramic insert sections also includes an inlet flange and an outlet flange. Fasteners are used for attaching each of the ceramic insert sections at their respective flanges. Refer also to the left and right side views shown in respective FIGS. 4 and 5 for further illustrations of the flanges and the securing fasteners.

Figure 5:
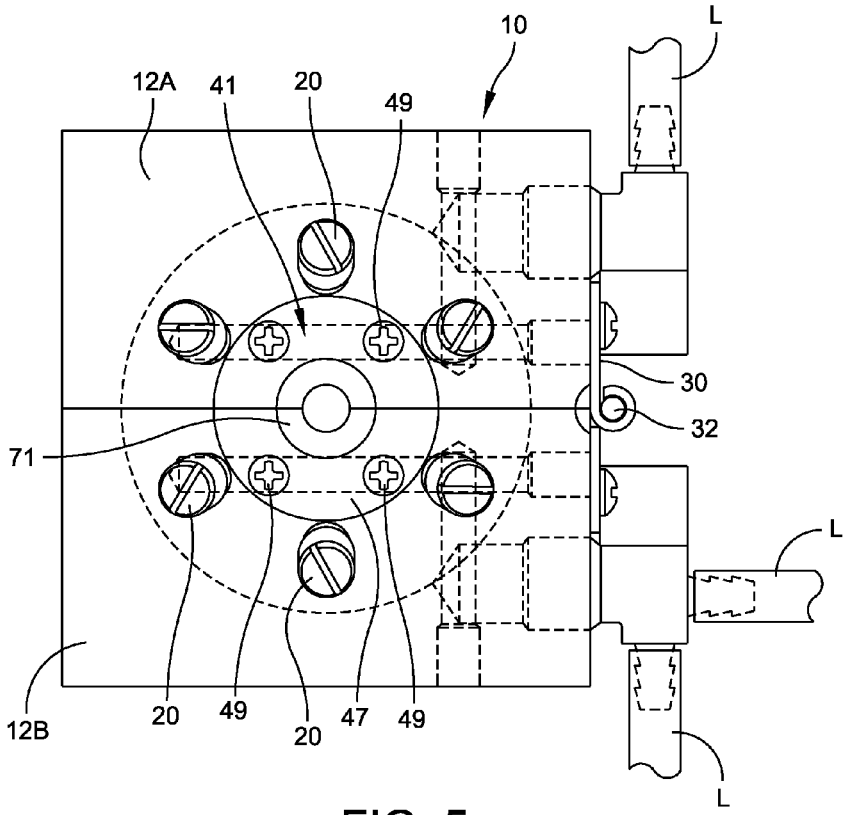
FIG. 5 is a right side view of the air wiping device of FIG. 1.

Each of the ceramic inserts when used with a particular wire or cable will have semi- circular passages that correspond so that once these are mated together when the housing is in a closed position, such as illustrated in FIGS. 4 and 5, a completed circular passage exists for receiving the elongated member. In order to substitute a different ceramic insert, one simply removes the fasteners and likewise removes each of the ceramic insert sections. Then, one can substitute another and different set of insert sections. A different set of insert sections may be used, for example, when accommodating a different size wire or cabling.

Having now described a limited number of embodiments of the present invention, it should now be apparent to one skilled in the art that numerous other embodiments and modifications thereof are contemplated as falling within the scope of the present invention.

What is claimed is:

1. An air wiping device for drying an elongated product that passes through the air wiping device, said air wiping device comprising:

a housing having an internal elongated tubular passage;

said housing tubular passage having an inlet end and an outlet end;

a first set of nozzles mounted at the one end of the housing for communicating a compressed gas stream to the internal elongated tubular passage;

a second set of nozzles mounted at the other end of the housing for communicating a compressed gas to the internal elongated tubular passage;

said first set of nozzles and said second sets of nozzles mounted for directing the respective gas streams obliquely to the internal elongated tubular passage;

said first set of nozzles and said second sets of nozzles mounted for directing the respective gas streams in a direction having a compressed gas stream component toward each other for discharge transversely from the housing, wherein said first set of nozzles and said second sets of nozzles are adapted to be screwed in or out of said housing tubular passage, further comprising, wherein said first set of nozzles and said second sets of nozzles are disposed about a 360 degree locus;

a ceramic insert disposed in the internal tubular passage of the housing and through which the elongated product passes; and said ceramic insert including a tapered input through which the elongated product is received and an output through which the elongated product passes from the housing.

2. The air wiping device of claim 1 wherein the housing is separated into two housing sections.

3. The air wiping device of claim 2 wherein the housing sections are connected by a hinge that biases the housing sections to a closed position.

4. The air wiping device of claim 2 wherein each of the housing sections is substantially semi-circular in shape.

5. The air wiping device of claim 1 wherein the ceramic insert is comprised of a pair of insert sections.

6. The air wiping device of claim 5 wherein the housing section includes a first housing section and a second housing section, the pair of insert sections including a first insert section and a second insert section, the first insert section mounted in the first housing section and the second insert section mounted in the second housing section.

7. The air wiping device of claim 6 including separate fastener means for removably attaching the respective insert sections to the housing sections.

8. The air wiping device of claim 1 including a mounting bracket for the housing that mounts the housing in a manner by which the housing may still move toward an open position should an object associated with the elongated product engage the tapered input so as to avoid damage to the device.

9. The air wiping device of claim 8 wherein the housing sections include a slot that is used for the support of the housing from the bracket.

10. The air wiping device of claim 1 wherein the first and second sets of nozzles extend at substantially the same angle to the longitudinal axis of the housing.

11. The air wiping device of claim I wherein the elongated tubular passage is defined with a tapered input through which the elongated product is received and an output through which the elongated product passes from the housing.

12. The air wiping device of claim 1 wherein the housing includes a transverse port that extends substantially orthogonal to the elongated tubular passage in the housing and for receiving the discharge from the housing.

13. The air wiping device of claim 1 wherein the housing includes a pair of separable housing sections and a transverse port that extends between the housing sections substantially orthogonal to the elongated tubular passage in the housing and for receiving the discharge from the housing.

14. An air wiping device for drying an elongated product that passes through the air wiping device, said air wiping device comprising:

a housing tubular passage having an internal elongated tubular passage through which the elongated product extends and including opposite one and other ends;

said housing tubular passage having an inlet end and an outlet end for respectively receiving and passing the elongated product;

a first set of air outlets mounted at the one end of the housing for communicating a compressed gas stream to the internal elongated tubular passage; a second set of air outlets mounted at the other end of the housing for communicating a compressed gas to the internal elongated tubular passage;

said first set of air outlets and said second sets of air outlets mounted for directing the respective gas streams obliquely to the internal elongated tubular passage; said first set of air outlets and said second sets of air outlets mounted for directing the respective gas streams in a direction having a compressed gas stream component toward each other for discharge transversely from the housing, wherein said first set of nozzles and said second sets of nozzles are adapted to be screwed in or out of said housing tubular passage;

each said set of air outlets directing an air stream at substantially the same angle to the elongated member axis, and each at an angle less than 90 degrees, further comprising, wherein said first set of nozzles and said second sets of nozzles are disposed about a 360 degree locus;

a ceramic insert disposed in the internal tubular passage of the housing and through which the elongated product passes; and said ceramic insert including a tapered input through which the elongated product is received and an output through which the elongated product passes from the housing.

15. The air wiping device of claim 14 wherein the housing is separated into two housing section, the housing sections are connected by a hinge that biases the housing sections to a closed position and each of the sets are disposed about a 360 degree locus.

16. The air wiping device of claim 14 wherein the input end of the housing tubular passage includes a tapered input through which the elongated product is received and an output through which the elongated product passes from the housing.

17. The air wiping device of claim 16 including a mounting bracket for the housing that mounts the housing in a manner by which the housing may still move toward an open position should an object associated with the elongated product engage the tapered input so as to avoid damage to the device.

18. The air wiping device of claim 17 wherein the housing sections include a slot that is used for the support of the housing from the bracket, and wherein the housing includes a transverse port that extends substantially orthogonal to the elongated tubular passage in the housing and for receiving the discharge from the housing.

19. The air wiping device of claim 14 wherein the housing includes a pair of separable housing sections and a transverse port that extends between the housing sections substantially orthogonal to the elongated tubular passage in the housing and for receiving the discharge from the housing.

* * * * *